US005991582A

United States Patent [19]

Liu et al.

[11] Patent Number: 5,991,582

[45] **Date of Patent: *Nov. 23, 1999**

[54] METHOD AND APPARATUS FOR DEVELOPING HIGH QUALITY IMAGES IN A LIQUID IMMERSION DEVELOPMENT MACHINE

[75] Inventors: Chu-Heng Liu, Penfield; Weizhong Zhao, Webster, both of N.Y.

[73] Assignee: Xerox Corporation, Stamford, Conn.

[ * ] Notice: This patent is subject to a terminal disclaimer.

[21] Appl. No.: 09/184,675

[22] Filed: Nov. 2, 1998

[51] Int. Cl.[6] ..... G03G 15/10; G03G 15/16

[52] U.S. Cl. ..... 399/237; 399/296

[58] Field of Search ..... 399/296, 308, 399/307, 237, 238, 239, 240

[56] References Cited

U.S. PATENT DOCUMENTS 4,974,027 11/1990 Landa et al. ..... 399/296 X
5,387,760 2/1995 Miyazawa et al. .
5,436,706 7/1995 Landa et al. .
5,519,476 5/1996 Dalal et al. ..... 399/307
5,619,313 4/1997 Domoto et al. ..... 399/233
5,826,147 10/1998 Liu et al. ..... 399/296 X
5,832,352 11/1998 Pan et al. ..... 399/307

*Primary Examiner*—Susan S. Y. Lee
*Attorney, Agent, or Firm*—Tallam I. Nguti

[57] ABSTRACT

A method and apparatus for producing high quality liquid toner images in an electrostatic printing machine. The method using the apparatus includes (a) forming in a first stage, an initial developed toner image on a photoreceptor using toner image forming assemblies including a charging device; and exposure device; a development unit;; and (b) refining in a second stage, the initial developed toner image using a contact electrostatic printing (CEP) assembly including a bias source and a conductive CEP roll for biasing and applying compressive and tensile forces to the initial developed toner image to enable easy separation of image areas from background areas of the initial developed toner image, and for separating and removing unwanted toner solids from the background areas, thereby producing a high quality final toner image having sharp image area edges and highly clean background areas.

10 Claims, 2 Drawing Sheets

METHOD AND APPARATUS FOR DEVELOPING HIGH QUALITY IMAGES IN A LIQUID IMMERSION DEVELOPMENT MACHINE

RELATED CASES

This application is related to U.S. application Ser. No. 09/184,674 entitled "METHOD AND APPARATUS FOR FORMING AND REFINING TONER IMAGES IN AN ELECTROSTATIC PRINTING MACHINE" filed on even date herewith; and U.S. application Ser. No. 09/184,136 entitled "METHOD AND APPARATUS FOR FORMING HIGH QUALITY AN ELECTROSTATIC PRINTING MACHINE" filed on even date herewith; and each having at least one common inventor.

BACKGROUND OF THE INVENTION

This invention relates generally to electrostatic latent image development, and, more particularly, concerns a method and apparatus for forming high quality toner images in a an electrostatic printing machine.

Generally, processes for electrostatographic copying and printing are initiated by selectively charging and/or discharging a charge receptive imaging member in accordance with an original input document or an imaging signal, generating an electrostatic latent image on the imaging member. This latent image is subsequently developed into a visible image by a process in which charged developing material is deposited onto the surface of the latent image bearing member, wherein charged solids in the developing material adhere to image areas of the latent image. The developing material typically comprises carrier granules having charged marking or toner solids adhering triboelectrically thereto, wherein the toner solids are electrostatically attracted from the carrier granules to the latent image areas to create a powder toner image on the imaging member.

Alternatively, the developing material may comprise a liquid developing material comprising a carrier liquid having pigmented marking solids (or so-called toner solids) and charge director materials dispersed and/or dissolved therein (so-called carrier liquid), wherein the liquid developing material is applied to the latent image bearing imaging member with the marking solids being attracted to the image areas of the latent image to form a developed liquid toner image. Regardless of the type of developing material employed, the charged toner or marking solids of the developing material are electrostatically attracted to the latent image to form a visible developed image corresponding to the latent image on the imaging member.

The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the imaging member or the nature of the latent image bearing member itself.

As described hereinabove, the typical electrostatographic printing process includes a development step whereby developing material including charged marking or toner solids is physically transported into contact with the imaging member so as to selectively adhere to the latent image areas thereon in an image-wise configuration. Development of the latent image is usually accomplished by electrical attraction of charged toner or marking solids to the image areas of the latent image. The development process is most effectively accomplished when the solids carry electrical charges opposite in polarity to the latent image charges, with the amount of toner or marking solids attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

The following disclosures may be relevant to some aspects of the present invention. U.S. Pat. No. 5,387,760 discloses a wet development apparatus for use in a recording machine to develop a latent image on a uniformly charged imaging carrier member toner image. The apparatus includes a development roller disposed in contact with or near the electrostatic latent image carrier and an application head for applying a uniform image of the wet developer to the roller.

U.S. Pat. No. 5,436,706 discloses an liquid immersion development (LID) machine including a first member having a uniformly charged first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The liquid immersion development (LID) machine also includes an apparatus for supplying liquid toner to the transfer region thereby forming on the second surface a thin image of liquid toner containing a relatively high concentration of charged toner solids, as well as an apparatus for developing the latent image by selective transferring portions of the image of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform image of charge having a second electrical potential onto the charge bearing surface, and image-wise dissipating charge from selected portions on the uniformly charged charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

Image quality is a concern with all electrostatographic printing applications or toner image forming methods including the conventional exemplary methods discussed above. In such methods, image quality in electrostatographic printing applications may vary significantly and unacceptably due to numerous conditions affecting latent image formation as well as development, among various other factors. In particular, image development can be effected by charge levels, both in the latent image, as well as in the developing material. For example, when the charge on dry toner solids becomes significantly depleted, binding forces with the carrier also become depleted, causing an undesirable increase in image development, which, in turn, causes the development of the latent image to spread beyond the area defined thereby. The unacceptable4 result is often unwanted toner solids in background or non-image areas.

Costly and high precision charging and development devices are often not desirable solutions to unacceptable image quality. There is therefore, for example, an ongoing need for a method and apparatus for forming in a printing machine high quality toner images that do not have poor quality backgrounds.

SUMMARY OF THE INVENTION

In accordance with one aspect of the present invention, there is provided a method of producing high quality toner images in an electrostatic printing machine. The method includes the steps of (a) forming an initial developed toner image on a photoreceptor using a first toner image forming assembly having a charging device for uniformly charging the photoreceptor, an exposure device for image-wise exposing the photoreceptor, and a development unit containing developer material including charged toner solids having a single polarity; and (b) refining the initial developed toner image using a contact electrostatic printing (CEP) toner image refining assembly including an image refining roll and a bias source coupled to the image refining roll. The method includes a surface of the image refining roll forming an image refining nip with the photoconductive surface of the photoreceptor, and the bias source cooperating with a charge pattern of the initial developed toner image to generate image-wise electric fields within the image refining nip, such that the image-wise electric fields together with the approaching motion of the two surfaces at an entrance to the nip, and separating motion of the two surfaces at an exit of the nip, enable easy separation of background area toner solids from image area toner solids of the initial developed toner image, thereby refining the initial developed toner image and producing a relatively high quality final toner solids image having sharp edges and no background deposits.

In accordance with another aspect of the present invention, there is provided an electrostatic printing machine for producing high quality toner images. The electrostatic printing machine comprises a movable photoreceptor having an image bearing photoconductive surface, and a first stage series of toner image forming assemblies including a charging device for first uniformly charging the image bearing photoconductive surface, an exposure device for image-wise exposing the charged photoconductive surface to form a latent image having image areas and background areas, and a contact development apparatus including developer material having charged toner solids therein for contacting the latent image to image-wise develop it into an initial developed toner image having wanted toner solids in the image areas and some unwanted toner solids in the background areas. The electrostatic printing machine also comprises a second stage biased contact electrostatic printing (CEP) toner image refining assembly, including a bias source coupled to a conductive and conformable roll that forms an image refining nip with the photoconductive surface of the photoreceptor. Within the image refining nip the photoreceptor and conformable roll apply compressive and tensile forces to the initial developed toner image as it is moving into the nip and away from the nip, and the bias source cooperates with the latent image pattern of the initial developed toner image to generate image-wise electric fields within the nip. The image-wise electric fields together with the compressive and tensile forces, enable easy separation of the background area toner solids from the image area toner solids of the initial developed toner image, thereby refining it and producing a relatively high quality final toner solids image having no background deposits.

In accordance with another aspect of the present invention, there is provided a method of producing high quality toner images in an electrostatic printing machine. The method includes the steps of (a) forming an initial developed toner image on a photoreceptor using a first toner image forming assembly having a charging device for uniformly charging the photoreceptor to a first potential, an exposure device for image-wise exposing portions of the photoreceptor to create a latent image having a potential contrast between image areas to be developed and background areas not to be developed, and a development unit containing developer material including charged toner solids having a toner potential suitable for only partially neutralizing the latent image potential contrast so as to leave a residual contrast between developed image areas and undeveloped background areas, and (b) refining the initial developed toner image using such residual contrast. The toner image refining member is biased to a potential which is intermediate the potentials of the developed image areas and of the background areas of the initial developed toner image. The method includes a surface of the image refining roll forming an image refining nip with the photoconductive surface of the photoreceptor, and the bias source cooperating with a charge pattern of the initial developed toner image to generate image-wise electric fields within the image refining nip, such that the image-wise electric fields together with the approaching motion of the two surfaces at an entrance to the nip, and separating motion of the two surfaces at an exit of the nip, enable easy separation of background area toner solids from image area toner solids of the initial developed toner image, thereby refining the initial developed toner image and producing a relatively high quality final toner solids image having sharp edges and no background deposits.

BRIEF DESCRIPTION OF THE DRAWINGS

These and other aspects of the present invention will become apparent from the following description in conjunction with the accompanying drawings in which.

DETAILED DESCRIPTION OF THE INVENTION

Figure 1:
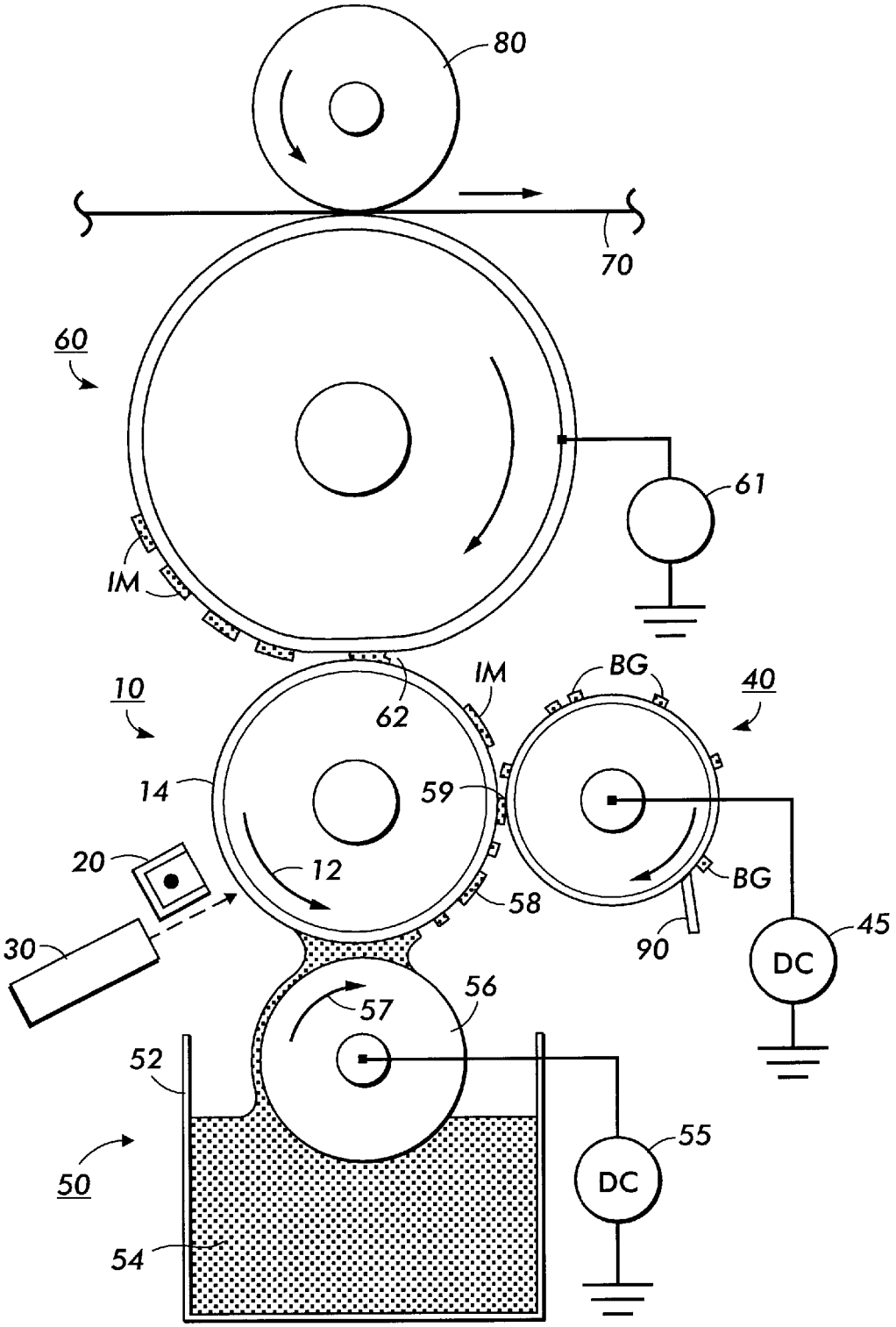
FIG. 1 is a schematic illustration of an electrostatic printing machine of the present invention in the form of a liquid immersion development (LID) machine, including a first stage series of toner image forming assemblies for forming an initial developed toner image, and a second stage image refining assembly for refining the initial developed toner image so as to produce a high quality toner image in accordance with the present invention.

For a general understanding of the features of the present invention, reference is made to the drawings, wherein like reference numerals have been used throughout to identify the same or similar elements. Although the following description will be directed to a liquid immersion development (LID) machine, it will be understood that the present invention contemplates the use of various alternative embodiments for the initial development of a toner image, as are well known in the art of electrostatographic copying and printing, including, for example, but not limited to, liquid toner development and dry toner development. On the contrary, the following description is intended to cover all alternatives, modifications, and equivalents, as may be included within the spirit and scope of the invention as defined by the appended claims.

Referring now to FIG. 1, the liquid immersion development (LID) machine of the present invention for forming relatively high quality toner images in accordance with the present invention is shown generally as B. As shown, the LID machine 8 includes a first stage series of assemblies of operatively associated image forming and refining elements in accordance with the present invention, including an imaging member 10. Imaging member 10 includes an imaging surface 14 of any type capable of having an electrostatic latent image formed thereon. An exemplary imaging member 10 may include a typical photoconductor or other photoreceptive component of the type known to those of skill in the art in electrophotography, wherein an imageable surface having photoconductive properties is supported on a conductive support substrate.

Although the following description will be directed to a photoconductive imaging member, it will be understood that the present invention contemplates the use of various alternative embodiments for an imaging member as are well known in the art of electrostatographic printing, including, for example, but not limited to, non-photosensitive imaging members such as a dielectric charge retaining member of the type used in ionographic printing machines, or electroded substructures capable of generating charged latent images.

Photoreceptor 10 is rotated, as indicated by arrow 12, so as to transport the surface 14 thereof in a process direction for implementing first stage and second stage series of image forming and refining steps in accordance with the present invention. Initially, as shown in FIG. 1, the photoconductive surface 14 of photoreceptor 10 passes through a series of initial toner image forming assemblies including a first charging assembly 20, an exposure assembly 30 and a development assembly 50, for forming an initial developed toner image 58. The first charging assembly may include a corona generating device 20 or any other charging apparatus for applying an electrostatic charge to the surface of the photoreceptor 10. The corona generating device 20 is provided for charging the photoconductive surface of photoreceptor 10 to a relatively high, substantially uniform potential. It will be understood that various charging devices, such as charge rollers, charge brushes and the like, as well as induction and semiconductive charge devices among other devices which are well known in the art may be utilized at the charging assembly for uniformly applying a charge potential to the surface of the photoreceptor 10.

After the photoreceptor 10 is brought to a substantially uniform charge potential, the charged surface 14 thereof is advanced to an image exposure assembly, identified generally by reference numeral 30. The image exposure assembly 30 projects a light image corresponding to an input image, to be reproduced, onto the charged photoconductive surface. The light image selectively dissipates the charge in portions thereof for recording a first latent image on the photoconductive surface in image configuration corresponding to the input image. The first latent image thus includes image areas having a first charge voltage, and background areas having a second charge voltage that is different from the first charge voltage. There is therefore a significant voltage or potential contrast between charged and discharged areas, or image areas to be developed with toner solids and background areas which will not be developed.

The image exposure assembly 30 may incorporate various optical image formation and projection components as are known in the art. For example, it may include various well known light lens apparatus or digital scanning systems for forming and projecting an image from an original input document onto the photoreceptor 10. Alternatively, various other electronic devices available in the art may be utilized for generating electronic information to create the electrostatic latent image on the imaging member.

The photoreceptor 10 then moves the first latent image on its surface to a development assembly 50 where both the image areas and background areas of the latent image are contacted with liquid developer material 54 so as to develop or make the first latent image visible with charged toner solids contained in the liquid developer material 54. As shown, the development assembly 50 includes a housing 52 that holds the liquid developer material 54 containing charged toner solids. The assembly 50 includes an applicator roll 56 that is biased by a source 55 for causing image-wise development or toner solids transfer from the applicator 56 to the first latent image on photoreceptor 10. The electrical bias from the source 55 is of a magnitude intended to cause toner solids to be transported from the applicator 56 to image areas of the first latent image, but ordinarily not to the background areas thereof, however some toner solids do undesirably transfer to background areas.

Importantly, the toner solids are charged so thay have a toner potential that is suitable for neutralizing, only partially, the charge in the image areas being developed. For example, where the image areas being developed were charged to +800v and remain at +800v after exposure to dissipate background areas to zero volts, a suitable voltage or potential for the toner solids will be −400v. The −400v toner solids when developed onto the +800v image area, will partially reduce the image area voltage to +400v, a 50% partially neutralization. The +400v is the residual potential between image areas and background areas at zero volts.

As shown, the applicator roll 56 rotates in the direction of the arrow 57 and transports a layer of the developer material 54 into contact with the first latent image on the surface of the photoreceptor 10. The latent image is thus developed as such by selectively attracting the charged toner solids onto image areas of the latent image to form an initial developed toner image 58 having wanted toner solids IM in image areas of the latent image, and some unwanted toner solids BG in background areas thereof.

The unwanted toner solids BG in the background areas of course represent poor or unacceptable image quality, as discussed for example in the background portion of this specification. In accordance with an aspect of the present invention, such poor image quality may be arrived at intentionally by using less costly, low latitude first stage series of assemblies 30, 50 as above., for forming the initial developed toner image. Ordinarily however, such poor image quality results from conventional initial developed toner image forming methods, particularly from development methods as carried out with the development assembly 50.

To summarize so far, the method includes the step of forming an initial developed toner image on a photoreceptor using a first stage series of toner image forming assemblies including a charging device for uniformly charging the photoreceptor to a first potential, and an exposure device for image-wise exposing portions of the photoreceptor to create a latent image having a potential contrast between image areas to be developed and background areas not to be developed. The first stage series of assemblies also include a development unit containing developer material including charged toner solids having a toner potential suitable for only partially neutralizing the latent image potential contrast so as to leave a residual contrast between developed image areas IM and undeveloped background areas.

As pointed out in the background portion of this specification, image quality concerns and problems are due to numerous conditions arising, for example, from latent image formation at the exposure assembly 30, and in particular from toner development at the development assembly 50. The predictably poor or relatively low quality result usually is the transfer or development of unwanted toner solids BG onto the background areas of the first latent image when the entire latent image (image areas and background areas thereof) is contacted, as above, with developer material by the development assembly 50. If the initial developed toner image 58 (image areas and background areas) to be transferred as such unrefined, onto a sheet of paper, it will clearly and undesirably include on such sheet of paper, such unwanted toner solids BG in the background areas.

However, in accordance with the present invention, any unwanted toner solids BG in background areas will be removed or significantly reduced by the second stage series of toner image refining assemblies, that are mounted downstream of the development apparatus 50. In addition, other image defects such as dragout will be significantly reduced or eliminated, advantageously resulting in high resolution and sharp edges for wanted toner solids in image areas of the final toner image, even if the initial developed toner image was only an ordinary low latitude developed toner image having significant unwanted background toner solids BG.

Figure 2:
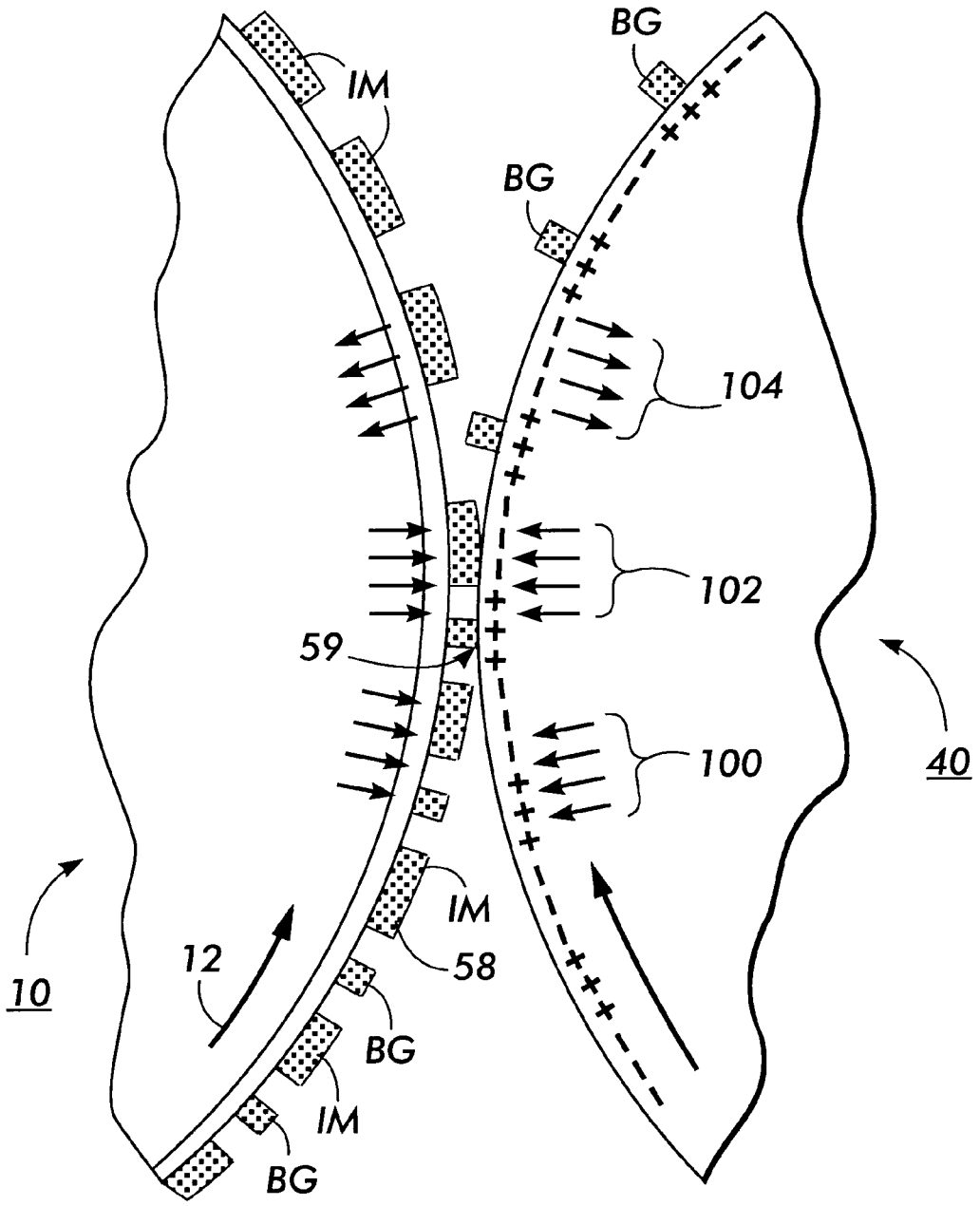
FIG. 2 is an exploded view illustrating the second stage image refining assembly of FIG. 1 further developing and refining an initial developed toner image in accordance with the present invention.

Referring now to FIGS. 1 and 2, the second stage, image refining assembly including a contact electrostatic printing (CEP) biased roll 40 of the present invention for further developing and refining the initial developed toner image 58, is illustrated. As shown, the second stage biased assembly, includes a bias source 45 coupled to a conductive and conformable roll 40 that forms an image refining nip 59 with the photoconductive surface of the photoreceptor 10. Specifically, the image refining method and apparatus, include a process nip 59 formed by operative engagement of the CEP biased roll 40 and the photoreceptor 10, for sandwiching the initial developed toner image 58. The image refining member is in pressure contact with the electrostatic latent image which generates image-wise electric fields across the layer of developer material, in the process nip. The process nip is defined by a nip entrance and a nip exit, wherein the process nip and the nip entrance are operative to apply compressive stress forces on the layer of developer material thereat, and wherein the nip exit is operative to apply tensile stress forces to the layer of developer material, thereby causing image-wise separation of the toner solids corresponding to image areas, and to background areas of the initial developed toner image 58.

Accordingly therefore, after the initial developed toner image 58 is formed on the surface of the photoreceptor 10, it is brought into pressure contact with the second stage image refining assembly including a biased CEP roll 40. Such contact is achieved by the photoreceptor 10 transporting the toner image 58 through the process nip 59 which it forms with the CEP biased roll 40. Within the image refining nip 59 the bias source cooperates with the latent image pattern of the initial developed toner image 58 to generate image-wise electric fields within the nip 59. Since it is an objective of the present invention to place the toner image 58 under pressure in the process nip 59, it may be desirable to provide either the CEP biased roll 40 or the photoreceptor 10 in the form of a conformable member (as shown in FIG. 2), thus permitting the surface of one member to conform to the opposing surface in the nip region.

As further illustrated in FIG. 1, an electrical biasing source 45 is coupled to the CEP biased roll 40 for applying an electrical bias thereto in order to generate electrostatic fields between the surface of CEP roll 40 and the toner image 58 (image areas and background areas thereof) on the photoreceptor 10. These generated electrostatic fields include field lines moving towards opposite directions depending on whether they are over image areas or over background areas of the initial developed toner image 58. Thus the field lines are either moving towards the surface of the photoreceptor 10, or towards the surface of biased CEP roll 40. Importantly, this difference in direction of the field lines advantageously will enable easy simultaneous separation of toner solids IM in the image areas from toner solids BG in the background areas of the toner image at the exit of the nip 59.

The biased CEP roll 40 is preferably conformable as shown in FIG. 2, and is resiliently engaged with the photoreceptor 10 for electrostatically and mechanically processing the toner image 58 within the nip 59. It is also preferable that the biased CEP roll 40 is conductive or has only a very thin dielectric coating. The roll 40 is biased by a source 45 and preferably at a voltage that is intermediate of the voltages of the image areas and non-image areas of the underlying latent image of the toner image 58. Importantly too, within the nip 59, the photoreceptor 10 and the CEP roll 40 should be moving in the same direction and at substantially the same speed so as to enable clean separation in accordance with the present invention, and to minimize image smear and distortion.

As shown, the biased CEP roll 40 is biased by the source 45 so as to cause it to repel toner solids IM in image areas, thereby resulting in a final refined toner image made up of the solids IM on the surface of the photoreceptor 10, while leaving background image byproduct or toner solids BG of the background areas, on the surface of the image refining biased roll 40.

In addition to the background removal, the image refining process can also remove some of the excess fluid in an initial developed liquid toner image. As illustrated in FIG. 2 as the toner image 58 enters the nip 59 and begins to travel therethrough it, compressive stress forces shown as 100 and 102 are initially generated and exerted upon the toner image 58. Excess fluid in the initial developed image can be removed due to the squeezing action of the compression. Thereafter, as the image 58 starts to exit the nip 59, and is being separated into image areas and background areas (as described above) onto the appropriate opposed surfaces, an image with high solid content is also produced.

Within the nip 59, the photoreceptor 10 and conformable CEP roll 40 apply the compressive and tensile forces to the initial developed toner image moving through the nip, and the bias source cooperates with the latent image pattern of the initial developed toner image to generate image-wise electric fields within the nip. The image-wise electric fields together with the compressive and tensile forces, enable separation of the background area toner solids BG from the image area toner solids IM of the initial developed toner image, thereby refining it and producing a relatively high quality and higher solid content final toner solids image IM having no background deposits.

In order to achieve good image refining, a strong image-wise force is required. Therefore, a strong image-wise field is desired. As will be understood, the latent image contrast is the origin of the image-wise field, substantial residual latent image contrast after the initial toner image development must remain to enable the image refining process. Therefore after formation of the initial developed toner image 58, substantial residual potential difference or contrast must exist between the image areas IM and background areas of the image 58. It is preferable that such a residual potential difference or contrast have an absolute magnitude of plus or minus 200v, and should be greater than one-third of the original or latent image potential contrast, (that is the difference between the potential of the charged and discharged areas of the first latent image). In addition, it also preferable that the residual potential contrast should be less than two-thirds of that original potential contrast in order to facilitate the second stage refining step of the present invention. This is in distinct contrast to conventional development processes in which an original, latent image potential contrast or difference in charge levels between charged and discharged areas usually is completely neutralized when charged toners reduce or increase the potential of the image areas so that they then equal that of background areas.

Due to the process latitude provided by the image refining process, the initial image development can operate in such a way to maximize the system performance. Conventionally, high speed development is difficult to achieve due to the limited toner mobility and development field. The great tolerance acceptable for forming of the initial developed toner image 58 in accordance with the current invention advantageously enables much greater development field and faster development. Even though the background quality and drag-out (as in liquid immersion development) are comparatively worse in the first stage, the second stage image refining process cures most of such image defects, and enables high speed development.

In one respect, the second stage image refining assembly 40 amounts to a second image forming process (image-wise charging of a toner solids pattern 58 and CEP electrostatic/mechanical force separation thereof into image areas and background areas), after latent image formation and toner development thereof on a photoreceptor. This second image forming process is for the purpose of refining the conventionally formed initial developed toner image 58. As a result, any image defects such as undesired or unwanted toner solids in background areas are effectively removed, and are not transferred along with the desired initial developed toner image areas at the separation nip. As such, image defects such as high background and drag-out (LID) are completely cured or substantially cured. The final results include high resolution and sharp edges restored to the image areas despite the initial image forming defects of the initial development step. Because of the capability of restoring high resolution to otherwise low quality, conventionally developed initial developed toner images, this refining step thus greatly reduces the need for high or tight constraints on the initial development step of the present invention.

To summarize further, the second stage method step includes the step of refining the initial developed toner image 58 using the residual contrast between developed toner image areas IM and the discharged background areas thereof. The toner image refining CEP roll 40 is biased to a potential which is intermediate the potentials of the developed image areas IM and of the background areas of the initial developed toner image 58. The second stage method step includes a surface of the image refining roll forming an image refining nip with the photoconductive surface of the photoreceptor, and the bias source cooperating with a charge pattern of the initial developed toner image to generate image-wise electric fields within the image refining nip, such that the image-wise electric fields together with the approaching motion of the two surfaces at an entrance to the nip, and separating motion of the two surfaces at an exit of the nip, enable easy separation of background area toner solids from image area toner solids of the initial developed toner image, thereby refining the initial developed toner image and producing a relatively high quality final toner solids image having sharp edges and no background deposits.

Once the unwanted background toner solids BG are separated onto the surface of CEP roll 40, the image area toner solids IM comprising a final refined toner image, are advanced to an intermediate transfer member (ITM) shown as a roll 60. As shown, ITM 60 is provided in the form of a biased roll member forming an image transfer nip 62 with the surface of the photoreceptor 10 and preferably contacting the final refined toner image IM residing on photoreceptor 10. An electrical biasing source 61 is coupled to the ITM 60 to bias the ITM 60 so as to attract the refined image area toner solids IM.

After the refined final toner image is transferred onto the ITM 60, it is then transferred to a copy substrate 70 via any means known in the art, which may include an electrostatic transfer apparatus including a corona generating device of the type previously described or a biased transfer roll. Alternatively, a pressure transfer system may be employed which may include a heating application device 80 for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto.

In a preferred embodiment, as shown in FIG. 1, the image is transferred to a copy substrate via a heated pressure roll, whereby pressure and heat are simultaneously applied by a heated roll 80 to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent. Since the art of electrostatographic printing is well known, it is noted that several concepts for transfer and/or fusing which could be beneficially used in combination with the image-wise charging system of the present invention have been disclosed in the relevant patent literature.

In a final step in the process, the background image byproduct on either the CEP roll 40 is removed from the surface thereof by a cleaning device 90 in order to clean the surface in preparation for a subsequent imaging cycle. FIG. 1 illustrates a simple blade cleaning apparatus for scraping the imaging member surface as is well known in the art. Alternative embodiments may include a brush or roller member for removing toner from the surface on which it resides.

To summarize, the present invention consists of (a) an initial toner/development combination that leaves considerable voltage contrast after development, and (b) a contact image refining and conditioning step (using a roll 40 or belt moving in same direction as the photoreceptor, and at substantially same speed) at an intermediate voltage, for removing background toner solids. Advantages include reduced image defects (background, halo, drag-out) and increased conventional development apparatus and method latitude. The present invention is distinct from conventional LID image development and conditioning methods in that it uses incomplete neutralization of surface potential by the initial developed toner image 58.

Any image defects associated with undesired toner solids in background areas are removed or reduced with the second, refining stage. Image defects such as high background and drag-out (LID) are cured or partially cured. High resolution and sharp edges are restored despite any imperfection of the initial, conventional development method and apparatus. The second, image refining stage can be also used as an image conditioning step to remove excess fluid from the toner image being refined.

It is, therefore, evident that there has been provided, in accordance with the present invention a high resolution, high quality toner image producing method and apparatus that fully satisfy the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A method of producing high quality toner images in an electrostatic printing machine, the method comprising the steps of:

(a) forming an initial developed toner image on a photoreceptor using a first series of toner image forming assemblies including a charging device for uniformly charging a photoconductive surface of the photoreceptor, an exposure device for image-wise exposing the photoconductive surface of the photoreceptor to form a latent image, and a development unit containing developer material including charged toner solids having a single polarity for forming an initial developed toner image; and (b) refining the initial developed toner image using a toner image refining assembly including a conductive contact electrostatic printing (CEP) roll and a bias source coupled to the CEP roll, the CEP roll forming an image refining nip with the photoconductive surface of the photoreceptor and applying compressive and tensile forces to the initial developed toner image moving through the image refining nip, and the bias source cooperating with a charge pattern of the initial developed toner image to generate image-wise electric fields within the image refining nip, and the image-wise electric fields together with the compressive and tensile forces, enabling easy separation of background area toner solids from image area toner solids of the initial developed toner image, thereby refining the initial developed toner image and producing a relatively high quality final toner solids image having sharp edges and no background deposits.

2. An electrostatic printing machine, for producing high resolution, high quality toner images, the electrostatic machine comprising:

(a) a photoreceptor having a photoconductive surface for supporting charge and a latent image formed thereon;

(b) a charging device for applying a uniform layer of charge on said photoconductive surface to produce a charged surface;

(c) an exposing device for image-wise exposing portions of said charged surface to form a latent image including image areas having a first charge level, and background areas having a second charge level different from the first charge level;

(d) a development apparatus including developer material containing charged toner solids for contacting said image areas and said background areas of said latent image, and for image-wise forming an initial developed toner image including image areas having wanted toner solids and background areas having some unwanted toner solids therein; and (e) a toner image refining assembly including a conductive contact electrostatic printing (CEP) roll and a bias source coupled to said CEP roll, said CEP roll forming an image refining nip with said photoconductive surface of said photoreceptor and applying compressive and tensile forces to the initial developed toner image moving through said image refining nip, and said bias source cooperating with a charge pattern of the initial developed toner image to generate image-wise electric fields within said image refining nip, and said image-wise electric fields together with said compressive and tensile forces, enabling easy separation of background area toner solids from image area toner solids of the initial developed toner image, thereby refining the initial developed toner image and producing a relatively high quality final toner solids image having sharp edges and no background deposits.

3. The electrostatic printing machine of claim 2, wherein said CEP roll is conformable so as to assure force application to the initial developed toner image by conforming to the surface of the photoreceptor within the image refining nip.

4. The electrostatic printing machine of claim 2, wherein within said image refining nip, said CEP roll is moving in a same direction as said photoreceptor.

5. The electrostatic printing machine of claim 2, wherein within said image refining nip, said CEP roll is moving at a same speed as said photoreceptor.

6. A method for producing high quality toner images in an electrostatic printing machine, the method, comprising the steps of:

(a) using a charging device to uniformly charge a photoconductive surface of a moving photoreceptor;

(b) image-wise exposing said photoconductive surface to generate a latent image thereon, said latent image including image areas having a first charge potential and background areas having a second and different charge potential so as to create an original potential contrast between image areas and background areas of the latent image;

(c) image-wise developing said latent image by contacting both image areas and background areas of said latent image with developer material containing charged toner solids to form an initial developed toner image having some unwanted toner solids in said background areas, the charged toner solids having a voltage suitable for partially neutralizing the voltage contrast between image areas and background areas; and (d) biasing and applying compressive and tensile forces to the initial developed toner image moving through a nip formed by a toner image refining assembly including a conductive contact electrostatic printing (CEP) roll and a bias source coupled to the CEP roll, so that the bias source cooperates with a charge pattern of the initial developed toner image to generate image-wise electric fields within the image refining nip, and the image-wise electric fields together with the compressive and tensile forces, enable easy separation of background area toner solids from image area toner solids of the initial developed toner image, thereby refining the initial developed toner image and producing a relatively high quality final toner solids image having sharp edges and no background deposits.

7. The method of claim 6, wherein said image-wise developing step includes using developer material containing charged toner solids having a potential suitable for partially neutralizing potential in image areas so as to result in a residual potential contrast of about 200v between developed image areas and undeveloped background areas of the initial developed toner image.

8. The method of claim 6, wherein said image-wise developing step includes using developer material containing charged toner solids having a potential suitable for partially neutralizing potential in image areas so as to result in a residual potential contrast that is greater than one-third of an original potential contrast between image areas to be developed and background areas of the latent image being developed into the initial developed toner image.

9. The method of claim 6, wherein said image-wise developing step includes using developer material containing charged toner solids having a potential suitable for partially neutralizing potential in image areas so as to result in a residual potential contrast that is less than two-thirds of an original potential contrast between image areas to be developed and background areas, of the latent image being developed into the initial developed toner image.

10. A method of producing a refined toner image having sharp edges and high quality clean background areas in an electrostatic printing machine having low latitude latent image forming and development devices, the method comprising the steps of:

(a) charging a photoconductive surface of an image bearing member of the electrostatic printing machine to a first potential;

(b) image-wise exposing the charged photoconductive surface to form a latent image including background areas having a second potential, and image areas having the first potential;

(c) developing the image areas with toner solids having a third potential to form a low latitude toner image having poorly formed edges and low quality background areas including some toner solids;

(d) contacting both image areas and background areas of the low latitude toner image with a biased electrostatic printing roll for generating electrostatic fields along with compressive and tensile forces to enable separation of toner solids in background areas from those in image areas so as to form sharp edges for the image areas and high quality clean background areas, thereby producing a highly refined final toner image; and (e) transferring the refined final toner image onto an image carrying substrate.

* * * * *